US007428298B2

(12) United States Patent
Bard et al.

(10) Patent No.: US 7,428,298 B2
(45) Date of Patent: Sep. 23, 2008

(54) MAGNETIC HEAD FOR X-RAY SOURCE

(75) Inventors: Erik C. Bard, Orem, UT (US); Charles R. Jensen, American Fork, UT (US); Arturo Reyes, Orem, UT (US); Shaun P. Ogden, Pleasant Grove, UT (US); Steven D. Liddiard, Provo, UT (US)

(73) Assignee: Moxtek, Inc., Orem, UT (US)

( * ) Notice: Subject to any disclaimer, the term of this patent is extended or adjusted under 35 U.S.C. 154(b) by 0 days.

(21) Appl. No.: 11/395,531

(22) Filed: Mar. 30, 2006

(65) Prior Publication Data

US 2007/0025516 A1 Feb. 1, 2007

Related U.S. Application Data

(60) Provisional application No. 60/667,250, filed on Mar. 31, 2005.

(51) Int. Cl.
*H01J 35/14* (2006.01)
*H01J 35/30* (2006.01)
*H01J 2/00* (2006.01)

(52) U.S. Cl. ..... 378/138; 378/137; 378/119

(58) Field of Classification Search ..... 378/119–123, 378/136–135, 143–145
See application file for complete search history.

(56) References Cited

U.S. PATENT DOCUMENTS 1,946,288 A * 2/1934 Kearsley ..... 378/107
3,679,927 A * 7/1972 Kirkendall ..... 378/137
4,160,311 A 7/1979 Ronde et al.
4,463,338 A 7/1984 Utner et al.
4,819,260 A * 4/1989 Haberrecker ..... 378/137
5,010,562 A 4/1991 Hernandez et al.
5,117,829 A 6/1992 Miller et al.
5,161,179 A 11/1992 Suzuki et al.
5,226,067 A 7/1993 Allred et al.
RE34,421 E 10/1993 Parker et al.
5,391,958 A 2/1995 Kelly
5,400,385 A 3/1995 Blake et al.
5,428,658 A 6/1995 Oettinger et al.
5,478,266 A 12/1995 Kelly
RE35,383 E 11/1996 Miller et al.
5,621,780 A 4/1997 Smith et al.
5,627,871 A * 5/1997 Wang ..... 378/121
5,729,583 A 3/1998 Tang et al.
6,005,918 A 12/1999 Harris et al.

(Continued)

FOREIGN PATENT DOCUMENTS

DE 1030936 5/1958

(Continued)

*Primary Examiner*—Irakli Kiknadze
(74) *Attorney, Agent, or Firm*—Thorpe North & Western

(57) ABSTRACT

An X-ray source includes a magnetic appliance to provide electron beam focusing. The magnetic appliance can provide variably focused and non-focused configurations. The magnetic appliance can include one or more electromagnets and/or permanent magnets. An electric potential difference is applied to an anode and a cathode that are disposed on opposite sides of an evacuated tube. The cathode includes a cathode element to produce electrons that are accelerated towards the anode in response to the electric field between the anode and the cathode. The anode includes a target material to produce x-rays in response to impact of electrons.

31 Claims, 1 Drawing Sheet

U.S. PATENT DOCUMENTS

| | | | | |
|---|---|---|---|---|
| 6,044,130 | A | 3/2000 | Inazura et al. | |
| 6,069,278 | A | 5/2000 | Chuang | |
| 6,075,839 | A | 6/2000 | Treseder | |
| 6,097,790 | A | 8/2000 | Hasegawa et al. | |
| 6,133,401 | A | 10/2000 | Jensen | |
| 6,134,300 | A | 10/2000 | Trebes et al. | |
| 6,184,333 | B1 | 2/2001 | Gray | |
| 6,288,209 | B1 | 9/2001 | Jensen | |
| 6,307,008 | B1 | 10/2001 | Lee et al. | |
| 6,320,019 | B1 | 11/2001 | Lee et al. | |
| 6,351,520 | B1 | 2/2002 | Inazaru | |
| 6,477,235 | B2 | 11/2002 | Chornenky et al. | |
| 6,487,272 | B1 | 11/2002 | Kutsuzawa | |
| 6,546,077 | B2 | 4/2003 | Chornenky et al. | |
| 6,658,085 | B2 * | 12/2003 | Sklebitz | 378/63 |
| 6,661,876 | B2 * | 12/2003 | Turner et al. | 378/138 |
| 6,778,633 | B1 * | 8/2004 | Loxley et al. | 378/113 |
| 6,976,953 | B1 * | 12/2005 | Pelc | 600/411 |
| 7,035,379 | B2 | 4/2006 | Turner et al. | |
| 7,046,767 | B2 * | 5/2006 | Okada et al. | 378/138 |
| 2005/0141669 | A1 * | 6/2005 | Shimono et al. | 378/137 |
| 2006/0233307 | A1 * | 10/2006 | Dinsmore | 378/136 |

FOREIGN PATENT DOCUMENTS

| | | |
|---|---|---|
| DE | 4430623 | 3/1996 |
| DE | 19818057 | 11/1999 |
| EP | 0297808 | 1/1989 |
| EP | 0330456 | 8/1989 |
| GB | 1252290 | 11/1971 |
| JP | 57082954 | 8/1982 |
| JP | 5066300 | 3/1993 |
| JP | 06119893 | 7/1994 |

* cited by examiner

MAGNETIC HEAD FOR X-RAY SOURCE

This application claims benefit to the priority of U.S. Provisional Application 60/667,250 filed Mar. 31, 2005 which is herein incorporated by reference in its entirety for all purposes.

BACKGROUND OF THE INVENTION

1. Field of the Invention

The present invention relates generally to an X-ray source with a focused electron beam. More particularly, the present invention relates to a miniature magnetic electron lens assembly for reducing the cross-section of an electron beam at its intersection with the anode target of a miniature, mobile X-ray tube, thereby reducing the size of its x-ray emitting region and increasing the local intensity of its X-ray output.

2. Related Art

In an X-ray tube, electrons emitted from a cathode are accelerated toward an anode by an electric field produced by a bias voltage maintained between the two electrodes. The intervening space must be evacuated to avoid electron energy loss and scattering through collisions with gas atoms or ions and to prevent ionization of containment gas and the subsequent acceleration of positive ions to the cathode, where they can damage the electron emission source and limit tube life. Characteristic and Bremsstrahlung X-rays are generated by electron impact upon the anode target material. Every material is relatively transparent to its own characteristic X-radiation, so if the target is sufficiently thin, there may be strong X-ray emission through the target material, exiting the surface of the target that is opposite the electron impact site. A device in this configuration is termed a transmission type, or "end window", X-ray tube. By comparison, a bulk anode tube, or "side-window" tube, has a thick, non-transparent target in the vacuum space, and its X-ray emission passes from the tube via an X-ray transparent window placed in the side of the vacuum chamber, as if reflected from the surface of electron incidence. Each anode type has its advantages and disadvantages, depending upon the intended application.

Typical high-power X-ray tubes are somewhat bulky and fragile. Such X-ray tubes must be energized by large, high-voltage power supplies that limit the mobility of the devices. Generally, specimens must be collected and brought to the stationary X-ray source for analysis. This is inconvenient for many X-ray applications. Certain "field applications", for which it is advantageous to take the instrument to the sample, rather than the sample to the instrument, include X-ray fluorescence (XRF) of soil, water, metals, ores, well bores, etc., as well as X-ray diffraction and material thickness measurements.

For low-power X-ray applications, such as XRF, one popular approach to device portability is the use of $^{109}$Cd as the x-ray source. This radioactive isotope of cadmium emits X-rays as a result of nuclear decay. There are many instruments incorporating radioactive cadmium currently in use, and methods have been developed to make XRF analysis with the energy emitted by the isotope sensitive and reliable. Unfortunately, the intensity of emission from $^{109}$Cd decays exponentially, with a half-life of about 1.2 years. This necessitates frequent recalibration and eventual disposal of the isotope source. In addition, the radioactivity of a cadmium source suitable for XRF is approximately 1-2 Curies, so a license is required for transportation and possession of the isotope at the quantity and activity level required.

Miniature, non-isotope X-ray tubes have been demonstrated for medical purposes. For example, see U.S. Pat. Nos. 5,729,583 and 6,134,300. The geometry of the referenced devices, however, is not ideal for miniature, portable XRF analysis. These medical X-ray tubes are designed to send radiation into at least $\pi$ steradians and to irradiate a relatively large specimen area for therapeutic reasons, rather than concentrating it into a beam or spot that is easily accessed by a detector. Thus, medical X-ray tubes are inadequate for most in-situ XRF analysis because of the divergence of their X-ray output. Another type of medical tube is a combination device in which the X-rays are used for diagnostic purposes, with the source placed inside the patient's body. Emitted X-rays pass through tissue to film that is external to the body, revealing the position of tumors or anatomic maladies. For example, see U.S. Pat. Nos. 5,010,562 and 5,117,829. With respect to the '562 patent, it is important to note that the foil is not a transmission type anode, but an electron window. With respect to the '829 patent, an interesting nozzle is shown, but the rest of the apparatus is large and inadequate for mobile fieldwork.

Another type of X-ray tube includes a rod anode used for insertion into pipes and boilers for X-ray inspection. The evacuated anode is hollow from the point at which the electron beam enters to the target surface at the opposite end. The whole rod structure is electrically biased at the anode potential. A window in the side of the rod allows X-rays to be emitted from inside the device. To focus the electron beam on the target at the end of the rod furthest from the cathode, an external magnetic coil is positioned coaxial with the rod, along its entire length. The electromagnet is heavy and requires considerable power from a large battery, if it is to be mobile. Additionally, the long anode of this configuration offers no benefit to typical analytical applications.

To obtain a concentrated source of X-rays at the anode of an X-ray tube, electron optics including lenses and apertures are usually employed. These optical elements are designed to focus the electron beam to a small diameter on the target, reducing the apparent size of the X-ray source. One example of such an optical element is a Wehnelt aperture, often used near the cathode of an electron microscope. A drawback of the Wehnelt aperture is that it significantly limits electron flux exiting the cathode. For XRF it is more important to limit the diameter of the electron beam where it strikes the anode, rather than at the cathode, since the anode is the site for the generation of X-rays directed at a (preferably) small portion of the analyte. The requirement of a small beam cross-section at the anode typically calls for other electrodes to act as beam-focusing elements. One example of such an element is a hollow, cylindrical focusing electrode spanning approximately half the distance from the cathode to the anode. An arrangement of this kind can be regarded as an electron lens. The field-shaping electrode, in effect, reduces the distance between anode and cathode, however; and it can increase the risk of electrical breakdown inside the X-ray tube.

An important feature of any device used to excite X-ray fluorescence for elemental analysis is that the point where the X-rays are generated should be as close as possible to the sample being irradiated. This is necessary, because the intensity of the X-rays decreases in proportion to the reciprocal of the square of the distance from the target. It is a further advantage to XRF analysis if the X-ray flux is focused to a small spot on the sample, for reasons of spatial resolution. A small X-ray source allows analysis of discrete, small portions of a complex sample.

In XRF, the X-ray beam is used to excite elements in the sample. The elements, in turn, fluoresce characteristic radiation in a Lambertian spatial distribution; so XRF sensitivity is maximized, if instrument geometry permits an angle of about 45° between the beam illuminating the analyte and the fluoresced X rays going into the detector. For generic X-ray tubes, the large apparent size of the x-ray source requires that the detector must be placed to one side, with an angle that is 90° or more instead of the desired 45° with respect to the incident radiation.

An object of the Treseder patent (U.S. Pat. No. 6,075,839) is to make the target accessible to the sample, but the exit window end of this invention is necessarily quite broad (greater than 20 mm). In addition, the anode is greatly recessed from the window, because the tube's electron gun is placed at the side of the anode instead of generally behind it. Moreover, it is impossible to modify the Treseder design to remedy this geometric disadvantage, because the target must be well separated from the X-ray window to make room for the curvature of the electron beam. The result is a large distance between the target and the sample, as shown in FIG. 3 of that patent.

Another requirement for sensitive XRF is that the sample be irradiated with X-rays of the correct wavelength or wavelengths for the material under inspection. Higher bias voltage not only increases X-ray flux, but it changes the energy distribution, or spectral content, of the output. Preferably, the anode-to-cathode bias voltage should be selectable by the operator and should be controlled independently of the anode to cathode current setting. In general, the higher the X-ray flux (and corresponding beam current), the more sensitive and accurate will be the measurements performed with the device, whether they are for XRF, material thickness measurement or X-ray diffraction. Only once the detector becomes saturated does additional X-ray flux offer no advantage. The current of the electron beam should, therefore, be adjusted independently of the acceleration voltage to provide adequate, but not excessive, X-ray intensity.

For generic X-ray tubes, substantial cooling is required, because the generation of X-rays by electron impact is a very energy-inefficient process. Less than one percent of the kinetic energy of the electron beam is actually converted to X-rays. The rest of the energy is converted to heat in the target. Heat is also generated by a thermionic electron source (i.e. a filament), if present. The heat generated in an X-ray tube should not, however, be permitted to substantially elevate the temperature of the device, because the lifetime of several tube components decreases with increasing temperature. Thermal shock, accompanying rapid changes in temperature, is also a particular concern. For thermal considerations, most X-ray tubes need to be cooled with a flowing liquid or forced air while in operation. Cooling effectiveness is limited primarily by the thermal conductivity of the bulk of the tube (e.g. the anode, in particular). Miniaturization mitigates this problem to some extent, but cooling is still required for the inventions of U.S. Pat. No. 6,075,839 (cooling by oil, $SF_6$, or forced air) and for U.S. Pat. No. 6,044,130, which has exterior protrusions to aid in cooling by forced air. To achieve sufficient X-ray flux, conventional X-ray tubes must be so large that they require active cooling. A sufficiently powerful tube, cooled by heat exchange with ambient air alone, is not common for any application.

Furthermore, the X-ray output of many X-ray tubes can, in general, suffer from variation in the size, shape and location of the electron beam cross section, or "spot", at the anode target. The electron beam can be relatively unfocused, misshapen, poorly positioned (i.e. off-axis) or subject to movement relative to the target, resulting in poorly concentrated, low level, or unstable output. This is a clear disadvantage to an analytical application, such as XRF, requiring stable, moderate levels of X-ray emission.

SUMMARY OF THE INVENTION

It has been recognized that it would be advantageous to develop a device for improved focusing and stability of an electron beam within an X-ray source, or a mobile, miniature X-ray source. It has also been recognized that it would be advantageous to develop an X-ray source that can be utilized in fixed-focused, variably focused, or non-focused configurations without substantially modifying certain physical aspects of the X-ray device.

The present invention provides for an X-ray source device with electron beam focusing. The X-ray source includes an evacuated tube with an anode, a cathode, and an insulator, enclosing an evacuated region. An anode assembly includes a material to produce X-rays in response to the impact of electrons. A cathode assembly is disposed in the tube opposing the anode. An electric potential difference can be applied between the anode and cathode. A result of the applied potential difference is an electric field within the vacuum region of the tube, sufficient to accelerate electrons to a desired kinetic energy. The cathode assembly includes an electron emitter, or cathode element, to produce electrons, directed and accelerated towards the anode in response to the applied electric field. An annular magnetic appliance can circumscribe the anode to focus an electron-beam.

In accordance with a more detailed aspect of the present invention, the X-ray source device can be configured to be both miniature and mobile. The cathode assembly can include a low-power cathode element with power consumption of approximately 1 watt or less. A power source can be electrically coupled to the anode, the cathode and the electron emitter.

In accordance with another more detailed aspect of the present invention, an X-ray transmissive window can be disposed in the evacuated tube at the anode end of the device. The window can be coaxial with the longitudinal axis of the evacuated tube, so as to transmit X-rays substantially along the longitudinal axis.

In accordance with another more detailed aspect of the present invention, the X-ray source device can include a magnetic focusing assembly having one or more permanent magnets, one or more electromagnets, or a combination of one or more permanent magnets and one or more electromagnets. In addition, the magnetic focusing assembly can consist of elements to shape and enhance the magnetic field in certain regions of space within the miniature, mobile X-ray source.

Additional features and advantages of the invention will be apparent from the detailed description which follows, taken in conjunction with the accompanying drawings, which together illustrate, by way of example, features of the invention.

DETAILED DESCRIPTION

Figure 1:
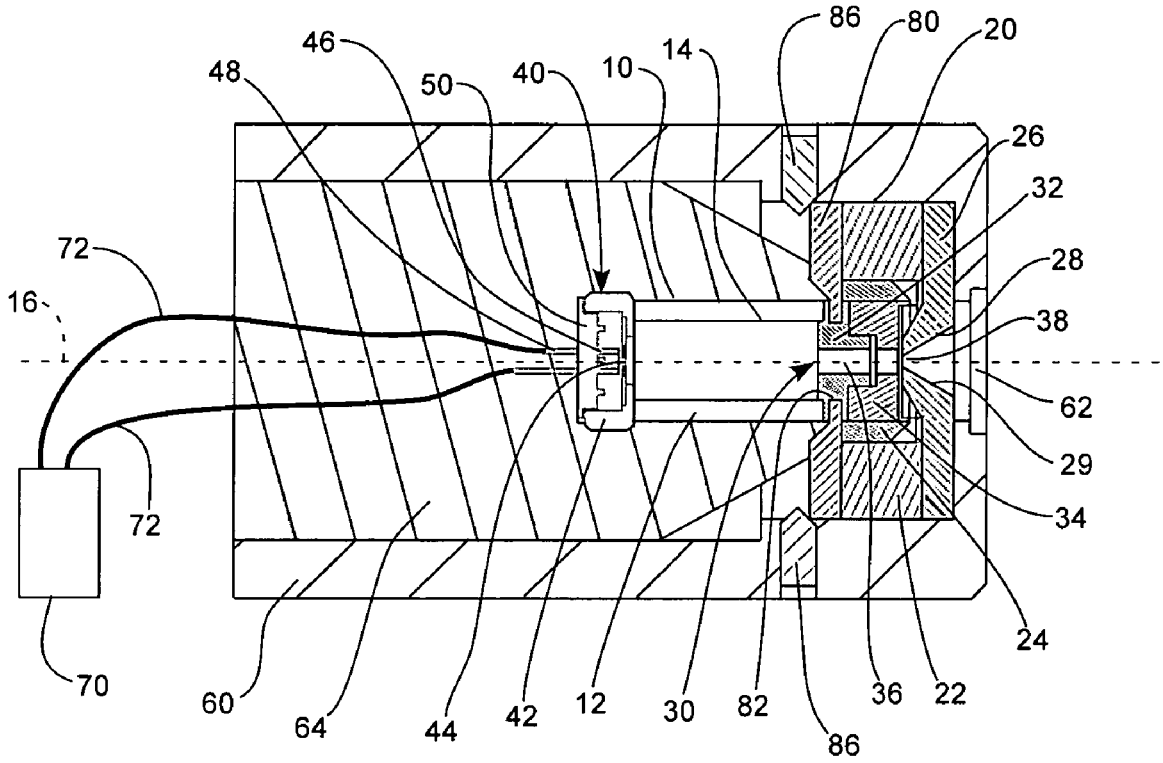
FIG. 1 is a cross-sectional side view of a mobile, miniature X-ray source with a magnetic focusing element in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a mobile, miniature X-ray source or tube, indicated generally at 10, in accordance with the present invention is shown. Various aspects of mobile, miniature X-ray sources are disclosed in U.S. Pat. No. 6,661,876, which is herein incorporated by reference. The X-ray source 10 advantageously includes a magnetic appliance, indicated generally at 20, coupled to the X-ray source 10 to provide electron beam focusing. The magnetic appliance 20, or a portion thereof, can be moveable to provide variable electron beam focusing. In addition, the magnetic appliance 20 can be removably coupled to the X-ray source 10, to provide both focused and non-focused configurations. The configuration of the magnetic appliance 20, including material specifications and dimensions, may be varied to afford variation of the degree of electron beam focusing, as deemed suitable for a particular application. "Field applications", such as X-ray fluorescence (XRF) of soil, water, metals, ores, well bores, etc., as well as diffraction and plating thickness measurements, are applications that can benefit from such an X-ray source 10.

The X-ray source 10 includes an evacuated tube 12. The X-ray source 10 can be a transmission-type X-ray source, and the tube can be a transmission type X-ray tube, as shown. The tube 12 can include an elongated dielectric cylinder 14, and in one aspect is formed of a ceramic material, such as aluminum oxide. Ceramic is believed to be superior to the traditionally used glass because of its dimensional stability and its ability to withstand higher voltages. Other dielectric materials, such as beryllia, quartz, or Macor may also be used. Extensions, forming portions of an anode and a cathode, can be directly and permanently attached at opposite ends of the dielectric tube. The extensions can be formed of a metal material and brazed to the ceramic.

As stated above, the X-ray source 10 can be miniature and mobile and suited for field applications. The X-ray tube 12 can have a length less than approximately 3 inches and a diameter or width less than approximately 1 inch to facilitate mobility and use in field applications.

An anode, indicated generally at 30, and a cathode, indicated generally at 40, are disposed in and/or form part of the tube 12. The anode 30 and cathode 40 are disposed at opposite ends of the tube 12. An electric potential difference is applied between the anode 30 and cathode 40. The anode 30 can be electrically grounded, as described below, while the cathode 40 can have a voltage applied thereto. The cathode 40 can be held at a negative high voltage relative to the grounded anode 30. In one aspect, the anode 30 can be held at a positive high voltage, while the cathode 40 is grounded. In another aspect, no grounding is imposed at either electrode, but the cathode 40 is the more negatively-biased element and the anode 30 the more positively biased element.

The cathode 40 can be a low power-consumption cathode and can include a low mass, low-power consumption cathode element 44, or filament. The cathode element 44 can be a thermionic emitter, such as a miniature, coiled tungsten filament. The cathode element 44 produces electrons. The emitted electrons are accelerated towards the anode 30 in response to the electric field between the anode 30 and the cathode 40. The cathode element 44 can have a low power consumption that is intended herein to mean power consumption of less than approximately 1 watt. The lower power consumption of the cathode element 44 allows the X-ray source 10 to be battery powered, and thus mobile. In addition, the cathode element 44 can have mass of less than approximately 100 micrograms.

A header or end cap 50 can be attached to the extension and included in the cathode assembly to support the cathode element 44. Pins or posts 46 can extend through the header or end cap, and can support the cathode element therebetween. High-voltage wires 48 can be electrically coupled to the pins 46, and thus the cathode element 44.

When the cathode element 44 is a thermionic (filament) type emitter, a potential of approximately 1 volt across the filament drives a current of approximately 200 mA through the filament, which raises the filament temperature to approximately 2300 K. This temperature is cool compared to most thermionic sources, but it provides sufficient electron emission for the intended applications of the X-ray tube. For example, only 20 μA are required to generate sufficient fluorescence from an alloy to saturate a semiconductor detector. Even higher emission efficiency is obtained if the tungsten cathode is coated with mixed oxides of alkaline earths (e.g. Cs, Ca, or Ba), and allows operation at temperatures as low as 1000 K. Such coated cathodes can have a low mass and power consumption, as described above.

There are numerous advantages to the relatively cool, coiled tungsten emitter compared to the conventional hot hairpin type. The cooler wire does not add as much heat to the X-ray device as a whole, and this eliminates the inconvenient requirement of a cooling mechanism. The lower temperature reduces tungsten evaporation as well, so tungsten is not deposited on the anode, and the wire does not rapidly become thin and break due to erosion. The cool tungsten coil, however, does not fall below the Langmuir limit, so space charge can accumulate between it and the Wehnelt optic or cathode optic, described below.

Alternatively, the X-ray source 10 can have specifications of: accelerating voltage up to approximately 80 kV; emission current up to approximately 0.2 mA; and beam spot size approximately 50 to 100 microns (as described below) at the anode target.

The anode 30 can include an extension 32 that is brazed to the evacuated tube 12. The extension 32 can be a ferromagnetic material, such as Kovar, that is a CTE match to the ceramic material of the evacuated tube 12. An end piece, or window mount 34, can be disposed on the extension 32. The window mount 34 can form a window support structure. The window mount 34 can be formed of Monel. A bore 36 can be formed through the tube extension 32 and the window mount 34 through which the electrons pass, defining an electron drift path or "drift tube".

A target window 38 is disposed at the anode 30 or the window mount 34 to produce X-rays in response to impact of electrons. The target window 38 can include an appropriate material, such as silver, for generating X-rays of required energies. The window or target window 38 can be a sheet or layer of material disposed on the end of the anode 30. For example, the target window 38 can be a 2-μm thick layer of silver deposited on a 250-μm thick beryllium disc. When electrons from the cathode 40 impact a silver target, characteristic X-ray emission is largely of the same wavelengths as the popular $^{109}$Cd radioactive X-ray sources. The target window 38 can be brazed to the window mount 34. Target material can be sputter-deposited on the vacuum-side of the target window 38. The target window 38 can also be made of beryllium or other sufficiently X-ray transmissive material.

A filter can be used to remove low-energy Bremsstrahlung radiation. The filter can be disposed at the anode 30 on the target window 38. The filter can include a filter material, such as beryllium. The filter can be a thin layer or sheet of beryllium. The filter or material thereof can coat the target window 38. With such a configuration, X-rays of certain energies, such as the silver L lines, may be emitted, but they can be absorbed after traveling a very short distance in air. It will be appreciated that additional filtering can be added after or instead of the beryllium, as described further in this disclosure. For example, one could use a balanced filter of the type described by U. W. Arndt and B. T. M. Willis in *Single Crystal Diffractometry*, Cambridge University Press, New York, 1966, p. 301.

The various components described above, including the tube 12, the tube extensions 32 and 42, the cathode assembly 40, the window mount 34, and the target window 38, form the evacuated X-ray source 10. A shield 60 can be disposed around the X-ray source device 10 to provide electrical shielding and shielding from off-axis X-rays. The shield 60 can be electrically coupled to the anode 30 to provide an electrical bias path for the anode 30. In addition, the shield 60 can be of material selected for electrical conductivity and X-ray opacity. The shield 60 can be a hollow, tubular or conical shell to allow insulation between the X-ray source device 10 and the shield 60 while contacting the anode 30. The shield can contain an opening, or exit aperture, for the transmission of X-rays from the X-ray source device 10.

The shield 60 can also contain features for mounting additional X-ray filters or windows at the exit aperture 62. The filter or target window 38 can also provide a physical barrier to prevent environmental debris from reaching the X-ray device 10. The shield 60 can also contain features, such as pins, holes, threaded protrusions or threaded holes for its attachment to external hardware. Additionally, the shield 60 can contain features, such as interior channels, or exterior protrusions, or "fins", to facilitate cooling of the X-ray source 10 in high temperature environments or high duty cycle applications. A region 64 between the shield 60 and the tube 12 can be filled with a dielectric potting compound, such as silicone rubber. In one aspect, the potting material can have a high thermal conductivity and can include high thermal conductivity materials, such as boron nitride, to assist with heat distribution and cooling. The potting material may also contain X-ray opaque material, such as bismuth, lead, aluminum, or the oxides thereof.

The X-ray source device 10 can also include and be operated by a battery powered, high voltage power supply 70, electrically coupled to the anode 30, the cathode 40, and the cathode element 44. The battery power source 70 can provide power for the cathode element 44, and the electric field between the anode 30 and the cathode 40. The battery power source 70 and the low-power consumption cathode element 44 can allow the X-ray source 10 to be mobile for field applications.

For analytical applications, it is important to maintain a constant level of X-ray emission. Therefore, a feature of the power supply 70 is that output stability is maintained, using feedback that is proportional to the emission current. Any drift in the resistivity of the tube is quickly compensated-for by this means, so that the tube current remains constant. The power supply 70 can be similar to that described in U.S. Pat. No. 5,400,385, but in the present invention, the power supply is small and battery powered.

As described above, the cathode element 44 can be a thermionic emitter. Other types of electron emitters also can be used. For example, a field emitter can be used. As another example of an electron emitter, a ferroelectric solid can be provided to emit electrons. Again, the cathode portion of the power supply can be adapted. In this case, the power supply 70 can provide pulses of appropriate voltage to the ferroelectric cathode.

Other electron emitters can be used, including metal tip arrays, gate-modulated emitters either in arrays or field emitting surfaces, carbon nanotubes with or without modulating gates, heated lanthanum hexaboride (LaB6), etc.

As described above, the X-ray source device 10 is configured to emit X-rays along its longitudinal axis, shown by dashed lines at 16. The cathode element 44 and target window 38 can be aligned coaxially with the longitudinal axis of the X-ray tube.

The tube 12 can be connected to the power supply 70 by flexible electrical cables 72 to make it easy to maneuver and position the device 10, and to allow the device to fit into long, narrow spaces. The electrical cables 72 can connect to pins 48 on the cathode header 50 inside the dielectric region 64 and to the anode 30 or to the shield enclosure 60. An alternative is to build the X-ray source as an integral part of the power supply, making a single unit with no exposed cables. The source/power supply combination may be small enough for spaces of moderate size.

In addition, the X-ray source device 10 advantageously includes a magnetic appliance, indicated generally at 20, to focus the electron beam at the site of impact with the target. The magnetic appliance 20 includes an annular magnet 22 circumscribing the anode 30 of the X-ray source. The annular magnet 22 can have a central aperture, sized to receive the anode 30 or window mount 34 therein. Alternatively, an annular spacer 24 of material having a magnetic permittivity of approximately 1, such as aluminum, can be placed between the magnet 22 and the anode 30.

In one aspect, the magnet 22 can consist of one or more permanent magnets. Advantageously, a permanent magnet consumes no power, requires no electrical connections or power supply. In another aspect, the magnet 22 can consist of one or more electromagnets, or a combination of one or more permanent magnets and one or more electromagnets. Advantageously, an electromagnet or a combination of permanent and electromagnets is that adjustability of the degree of electron beam focusing is possible without physical modification of the device or its configuration. For example, variable focus can be accomplished by varying coil current in the electromagnet.

The magnet may also be of a variety of sizes, shapes, and strengths. For example, the magnet can be a permanent magnet with a BHmax of approximately 10 to 50 Megagauss Oersted (MGOe). In another aspect, the magnet can be a permanent magent with a BHmax of approximately 30-40 Megagauss Oersted (MGOe). The annular magnet 23 can be removably disposed around the anode, as described below.

The magnetic appliance 20 can also include an annular exit pole piece 26 disposed proximate and forward (further from cathode) of the annular magnet 22. The annular exit pole piece 26 can be formed of a ferromagnetic material, such as steel or nickel. The annular exit pole piece 26 can include an aperture 28 to permit the axial transmission of X-rays produced at the target window 38 out of the device 10. The aperture 28 can be conical, extending from a smaller, rearward opening near the target window 38 toward a larger, forward opening, further from the anode target window 38. In addition, the pole piece 26 can include an annular, central protrusion 29 extending rearward to the window mount 34 or anode 30. The pole piece 26 can contact the anode 30, the target window 38, or the window mount 34.

The annular exit pole piece 26 can also be formed of two or more separate, concentric pieces of ferromagnetic material which can be moved relative to one another, in order to achieve variation in the focusing action of the magnetic lens by mechanical means. The combination of the concentric parts can form a single adjustable, compound pole piece. The pieces can be fastened and positioned relative to one another by helical threading on the exterior radial surface of a central piece and on the interior radial surface of an outer piece. The central piece, containing the aperture 28 and central protrusion 29, can be rotated about the longitudinal axis 16, relative to the outer piece and remainder of the X-ray device 10, resulting in translation of the center of the pole piece along the longitudinal axis 16 of the device 10. Translation of the center of the compound pole piece will result in changes in the magnetic field strength near the anode target window 38 and subsequent change in the degree to which the electron beam cross-section is reduced on the target window 38, inside of the X-ray tube 12. The effect of this adjustment can be a change in the size, shape, and location of the X-ray emission, or X-ray "spot", produced by the device.

The annular exit pole piece 26, or the central part thereof, can also contain features to accommodate an X-ray window or filter which is not an integral part of the X-ray source 10. The x-ray filter can be made of material chosen to selectively modify the spectral content, or energy distribution, of X-ray emission from the device as a whole. The filter or window can also provide a physical barrier to prevent environmental debris from reaching the target window. In particular, metallic debris, which may be attracted to the magnetic field in the vicinity of the magnetic appliance 20, may be prevented from reaching the target window of the device 10, where it would obscure or otherwise alter X-ray emission generated at the anode target window 38. Additionally, the annular exit pole piece 26, or the central part thereof, can also include features necessary to physically couple the device with an X-ray capillary optic or other hardware.

The annular exit pole piece 26, or the central part thereof, can also be coated with a layer of material, chosen for its X-ray fluorescence properties. The coating can be made of material chosen to match the spectral properties of the anode target window 38 or of material chosen to selectively modify the spectral content, or energy distribution, of X-ray emission from the device as a whole.

The magnetic appliance 20 can also include a second compound, annular pole piece 80 consisting of a shunt, disposed proximate and rearward (nearer to the cathode) of the annular magnet 22, and tube extension 32. The shunt 80 can circumscribe the anode 30 or tube extension 32. The shunt 80 can have an aperture 82 with a diameter less than a diameter of the evacuated tube 12. The shunt 80 can be split into two pieces, so that it can be assembled around the tube 12 or extension 32. The shunt 80 can contact the extension 32. The shunt 80 can interlock with features on the extension 32, such as an annular groove, for positive physical location and good magnetic coupling. The shunt 80 can be formed of a ferromagnetic material, such as steel or nickel.

Anode components, extension 32 and window mount 34, the annular magnet 22, the shunt 80, and the pole piece 26 can form a magnetic lens. The extension 32 can be formed of a ferromagnetic material, such as Kovar, while the window mount 34 can be formed a material having a relative magnetic permeability of approximately 1, such as Monel. The geometric relationship and material composition of the lens components have a combined effect that focuses the electron beam within the X-ray device 10 in the vicinity of the anode target window 38. The magnetic lens focuses the beam to a cross-sectional diameter which is reduced to least ½ to $1/50^{th}$ in size, relative to an unfocused electron beam produced without the magnetic appliance 20. For example, the focused beam spot size has been measured at approximately 50-100 μm in certain embodiments.

The anode 30, the annular magnet 22, the shunt 80 and the pole piece 26 can be electrically biased to the anode potential.

In addition, the evacuated tube 12, the dielectric which occupies the dielectric region 64, and the magnetic appliance 20 can be removably disposed in the shield enclosure 60. For example, set screws 86 can retain the assembly in the shield enclosure 60. The set screws 86 can be removed so that the X-ray source device 10 and magnetic appliance 20 can be removed from the interior of the shield enclosure 60.

The magnet 22 can be removed from the lens assembly to allow for an unfocused electron beam. Alternatively, if the magnet 22 is an electromagnet, the electromagnet can be operated at zero current, or it can be physically removed altogether to allow for an unfocused electron beam. The tube 12 can be placed in a different, or the same, shield enclosure 60 with or without the magnetic appliance 20. Thus, the device 10 can have a focus configuration, in which the annular magnet 22 is disposed around the anode 30, and a non-focused configuration, in which the annular magnet 22 is removed from the anode 30.

The magnetic appliance 20 has also been experimentally found to reduce beam spot size, improve beam spot positional stability, and to reduce electron beam backscatter and the consequences thereof.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. An X-ray source device with a magnetic appliance coupled to its anode for electron beam focusing, comprising:

a) an evacuated tube;

b) an anode, coupled to the tube, including a material configured to produce X-rays in response to impact of electrons;

c) a cathode, coupled to the tube opposing the anode, including a cathode element, configured to produce electrons accelerated towards the anode in response to an electric field between the anode and the cathode, d) an annular magnetic appliance, circumscribing the anode, to focus an electron-beam; and e) wherein the annular magnetic appliance provides focusing of an electron beam within the X-ray source device, the resulting focused electron beam having a cross-sectional diameter reduced to at least ½ to $1/50^{th}$ in size relative to an unfocused electron beam produced without the annular magnetic appliance.

2. A device in accordance with claim 1, wherein:

the evacuated tube has a length less than approximately 3 inches, and a diameter or width less than approximately 1 inch;

the cathode includes a low-power consumption cathode element having a low power consumption less than approximately 1 watt; and further comprising:

a battery power source, electrically coupled to the anode, the cathode, and the cathode element, to provide power for the cathode element, and to provide the electric field between the anode and the cathode.

3. A device in accordance with claim 2, wherein the battery power source includes a battery operated, high voltage power supply and provides an electric field between the anode and the cathode between approximately 4 to 80 kilo-volts.

4. A device in accordance with claim 1, wherein the annular magnetic appliance provides focusing of an electron beam within the X-ray source device, the resulting focused electron beam having a crosssectional diameter reduced at least $1/10^{th}$ in size relative to an unfocused electron beam produced without the annular magnetic appliance.

5. A device in accordance with claim 1, wherein the annular magnetic appliance further comprises:

an annular magnet, circumscribing the anode and having magnetic poles oriented parallel with a longitudinal axis of the annular magnet and the evacuated tube;

an annular pole piece, disposed proximate and axially forward of the annular magnet and having a longitudinal axis coaxial with the longitudinal axis of the evacuated tube; and an annular shunt, disposed proximate and axially rearward of the annular magnet and having a longitudinal axis coaxial with the longitudinal axis of the evacuated tube.

6. A device in accordance with claim 5, wherein the anode, the annular magnet, the shunt, and the pole piece form a magnetic electron beam focusing lens.

7. A device in accordance with claim 5, wherein the annular pole piece is positionally adjustable.

8. A device in accordance with claim 1, wherein the anode further comprises:

a tube extension, attached to the evacuated tube, formed of a ferromagnetic material;

a window mount, attached to the tube extension, having a target; and a drift tube, extending through and defined by the tube extension and the window mount, terminating at the target.

9. A device in accordance with claim 8, wherein the window mount has a magnetic permeability of approximately 1, and the annular magnet appliance includes an annular magnet with a magnetic energy product (BHmax) of approximately 30-40 Megagauss Oersteds.

10. A device in accordance with claim 8, wherein the window mount has a magnetic permeability of approximately 1, and the annular magnet appliance includes an annular magnet with a magnetic energy product (BHmax) of approximately 10-50 Megagauss Oersteds.

11. A device in accordance with claim 8, further comprising:

an annular magnet, circumscribing the anode and having magnetic poles oriented parallel with a longitudinal axis of the annular magnet and the evacuated tube;

an annular shunt, disposed proximate and rearward of the annular magnet, and contacting the tube extension, the shunt being formed of a ferromagnetic material; and an annular pole piece, disposed proximate and forward of the annular magnet, and contacting the window mount, the pole piece being formed of a ferromagnetic material.

12. A device in accordance with claim 11, wherein the shunt and the pole piece have a magnetic permeability of approximately 10.

13. A device in accordance with claim 11, wherein the shunt and the pole piece have a magnetic permeability of greater than 1.

14. A device in accordance with claim 11, wherein the pole piece includes an exit aperture for the transmission of X-rays.

15. A device in accordance with claim 14, wherein the pole piece aperture is conical, having a smaller rearward opening nearest a site of X-ray production at the anode and a larger forward opening further from the site of X-ray production.

16. A device in accordance with claim 11, wherein the pole piece includes a central protrusion extending rearward to the window mount or anode.

17. A device in accordance with claim 11, wherein the anode, the annular magnet, the shunt and the pole piece are electrically grounded.

18. A device in accordance with claim 11, wherein the shunt is split into two pieces and has a central aperture with a diameter less than a diameter of the evacuated tube.

19. A device in accordance with claim 11, wherein the evacuated tube, the anode, the annular magnet, the shunt and the pole piece are disposable in a shield enclosure.

20. A device in accordance with claim 11, wherein at least the annular magnet is removably disposed on the anode.

21. A device in accordance with claim 1, wherein at least a portion of the annular magnet appliance is moveable.

22. A device in accordance with claim 1, wherein the magnetic appliance includes an electromagnet.

23. A device in accordance with claim 1, further comprising a window, disposed in an end of the evacuated tube, configured to release X-rays, the window being aligned with a longitudinal axis of the evacuated tube configured to release X-rays substantially along the longitudinal axis.

24. A device in accordance with claim 1, wherein the annular magnetic appliance circumscribes the anode without substantially circumscribing the tube.

25. A device in accordance with claim 1, wherein the annular magnetic appliance is coupled directly to the anode.

26. A device in accordance with claim 1, wherein the X-ray source is a transmission-type X-ray source.

27. A device in accordance with claim 1, wherein the annular magnetic appliance is removable.

28. A device in accordance with claim 1, wherein the annular magnetic appliance includes at least one permanent magnet.

29. An X-ray source device with a magnetic head for electron beam focusing, comprising:

a) an evacuated tube formed of a ceramic material;

b) an anode, disposed at one end of the tube, including:

i) a tube extension, brazed to the evacuated tube, formed of a ferromagnetic material;

ii) a window mount, attached to the tube extension, including a target with a material configured to produce X-rays in response to impact of electrons; and iii) a drift tube, extending through and defined by the tube extension and the window mount;

c) a cathode, disposed at another end of the tube opposing the anode, including a cathode element configured to produce electrons accelerated towards the anode in response to an electric field between the anode and the cathode;

d) an annular magnet, circumscribing the anode;

e) an annular exit pole piece, proximate to and forward of the annular magnet, extending to the window mount; and f) an annular shunt, proximate to and rearward of the annular magnet, defining a second pole piece, extending to the tube extension.

30. A device in accordance with claim 29, wherein:

the evacuated tube has a length less than approximately 3 inches, and a diameter or width less than approximately 1 inch;

the cathode includes a low-power consumption cathode element having a low power consumption less than approximately 1 watt; and further comprising:

a battery power source, electrically coupled to the anode, the cathode, and the cathode element, to provide power for the cathode element, and to provide the electric field between the anode and the cathode.

31. A magnetic head device for focusing an electron beam of an X-ray source, comprising:

an annular magnet, including at least one permanent magnet, configured to circumscribe an anode;

an annular pole piece, proximate to and forward of the annular magnet;

an annular shunt, proximate to and rearward of the annular magnet, defining a second pole piece.

* * * * *